US010175624B2

(12) United States Patent
Iwasaki et al.

(10) Patent No.: US 10,175,624 B2
(45) Date of Patent: Jan. 8, 2019

(54) IMAGE FORMING APPARATUS INCLUDING A CHARGING MEMBER CONFIGURED TO ROTATE AT A PERIPHERAL VELOCITY DIFFERENT FROM A PERIPHERAL VELOCITY AT WHICH AN IMAGE CARRIER ROTATES

(71) Applicant: FUJI XEROX CO., LTD., Tokyo (JP)

(72) Inventors: Jin Iwasaki, Kanagawa (JP); Ken Ozaki, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/675,167

(22) Filed: Aug. 11, 2017

(65) Prior Publication Data

US 2018/0095392 A1 Apr. 5, 2018

(30) Foreign Application Priority Data

Oct. 3, 2016 (JP) ..... 2016-195490

(51) Int. Cl.

| | |
|---|---|
| ***G03G 15/02*** | (2006.01) |
| ***G03G 15/00*** | (2006.01) |
| ***G03G 21/16*** | (2006.01) |
| *G03G 21/18* | (2006.01) |

(52) U.S. Cl.

CPC ..... *G03G 15/5008* (2013.01); *G03G 15/0233* (2013.01); *G03G 21/169* (2013.01); *G03G 15/0258* (2013.01); *G03G 21/1814* (2013.01)

(58) Field of Classification Search

CPC ..... G03G 15/0216; G03G 15/0225; G03G 15/0233; G03G 15/0258; G03G 15/0266; G03G 15/5008

USPC ..... 399/50, 100, 167

See application file for complete search history.

(56) References Cited

U.S. PATENT DOCUMENTS

| | | | | |
|---|---|---|---|---|
| 7,603,058 | B2 | 10/2009 | Iwasaki et al. | |
| 7,738,803 | B2 * | 6/2010 | Fujita et al. | G03G 15/0216 399/50 |
| 7,756,462 | B2 | 7/2010 | Iwasaki et al. | |

FOREIGN PATENT DOCUMENTS

| | | | |
|---|---|---|---|
| JP | 2005-258322 | A | 9/2005 |
| JP | 2007-034258 | A | 2/2007 |
| JP | 2007-163974 | A | 6/2007 |
| JP | 2008-003146 | A | 1/2008 |

* cited by examiner

*Primary Examiner* — William J Royer
(74) *Attorney, Agent, or Firm* — Sughrue Mion, PLLC

(57) ABSTRACT

An image forming apparatus includes a rotatable image carrier that carries an image, a charging unit having a rotatable charging member that charges the image carrier, a developing unit that supplies a developer including at least toner to the charged image carrier, and a cleaning unit having a cleaning member that cleans a surface of the image carrier. At least when the image forming apparatus is not performing image formation, the charging member on which the toner from the image carrier is carried is caused to rotate at a peripheral velocity different from a peripheral velocity at which the image carrier rotates.

15 Claims, 9 Drawing Sheets

IMAGE FORMING APPARATUS INCLUDING A CHARGING MEMBER CONFIGURED TO ROTATE AT A PERIPHERAL VELOCITY DIFFERENT FROM A PERIPHERAL VELOCITY AT WHICH AN IMAGE CARRIER ROTATES

CROSS-REFERENCE TO RELATED APPLICATIONS

This application is based on and claims priority under 35 USC 119 from Japanese Patent Application No. 2016-195490 filed Oct. 3, 2016.

BACKGROUND

Technical Field

The present invention relates to an image forming apparatus.

SUMMARY

According to an aspect of the invention, there is provided an image forming apparatus including a rotatable image carrier that carries an image, a charging unit having a rotatable charging member that charges the image carrier, a developing unit that supplies a developer including at least toner to the charged image carrier, and a cleaning unit having a cleaning member that cleans a surface of the image carrier. At least when the image forming apparatus is not performing image formation, the charging member on which the toner from the image carrier is carried is caused to rotate at a peripheral velocity different from a peripheral velocity at which the image carrier rotates.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the drawings. The following description of the exemplary embodiments is only illustrative of an image forming apparatus for embodying the technical idea of the present invention and not intended to limit the invention to the specific exemplary embodiments illustrated, and is equally applicable to other exemplary embodiments that fall within the scope of the claims.

Exemplary Embodiment 1

Figure 1:
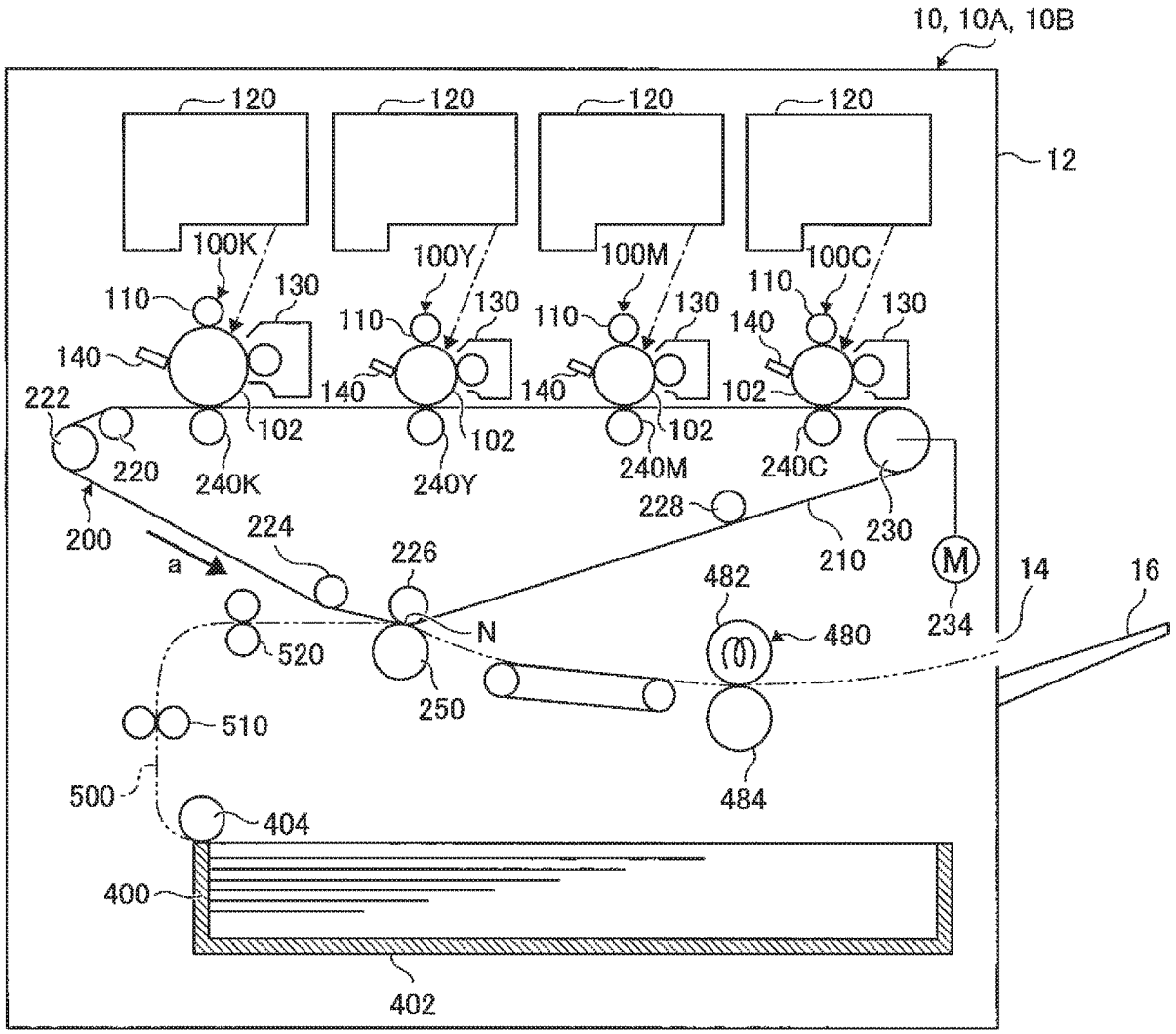
FIG. 1 illustrates an image forming apparatus according to each of Exemplary Embodiments 1 to 3 of the present invention.

First, an image forming apparatus 10 according to Exemplary Embodiment 1 will be described with reference to FIG. 1. As illustrated in FIG. 1, the image forming apparatus 10 according to Exemplary Embodiment 1 includes an image forming apparatus body 12. The following components are disposed inside the image forming apparatus body 12: an image forming unit 100K that forms a black toner image, an image forming unit 100Y that forms a yellow toner image, an image forming unit 100M that forms a magenta toner image, an image forming unit 100C that forms a cyan toner image, a transfer device 200, a fixing device 480, and a paper feeder 400. A transport path 500 for transporting paper used as a recording medium is defined inside the image forming apparatus body 12.

The image forming apparatus body 12 has an eject opening 14 for ejecting paper. The image forming apparatus body 12 is also equipped with an eject tray 16, which is used as an eject part to which a sheet of paper on which an image has been formed is ejected.

Figure 2A:
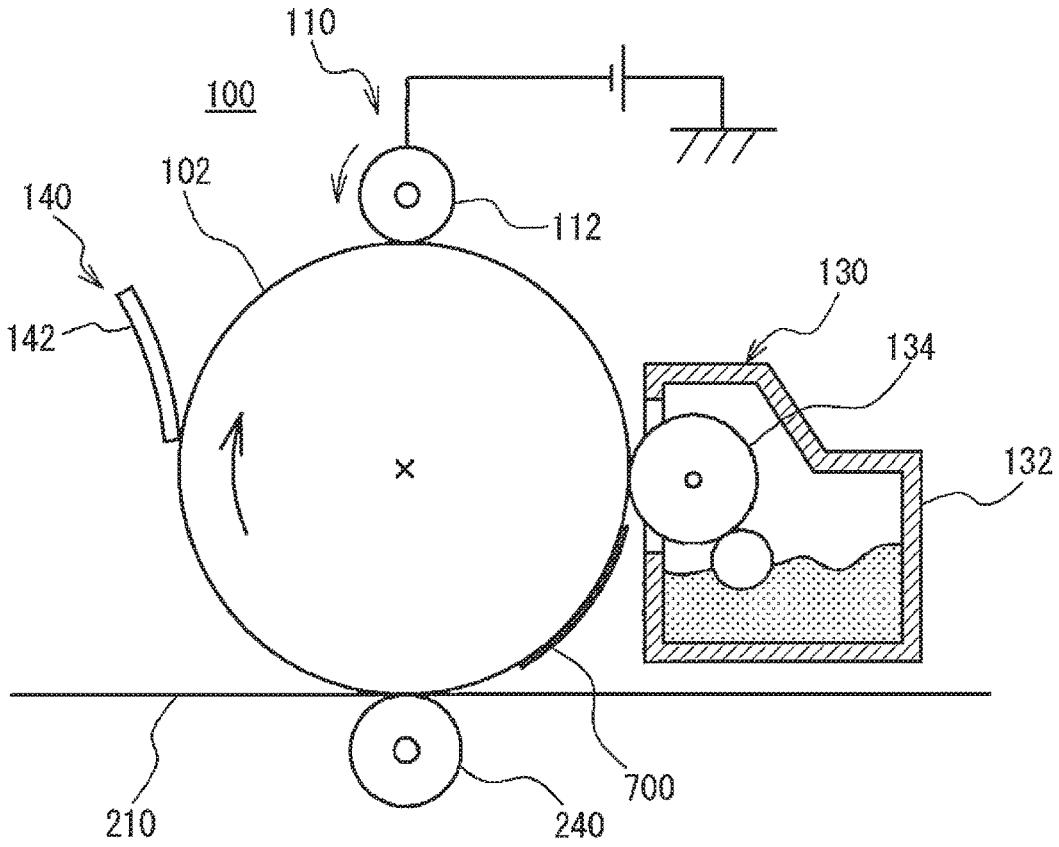
FIG. 2A illustrates an image forming unit according to Exemplary Embodiment 1.
Figure 2B:
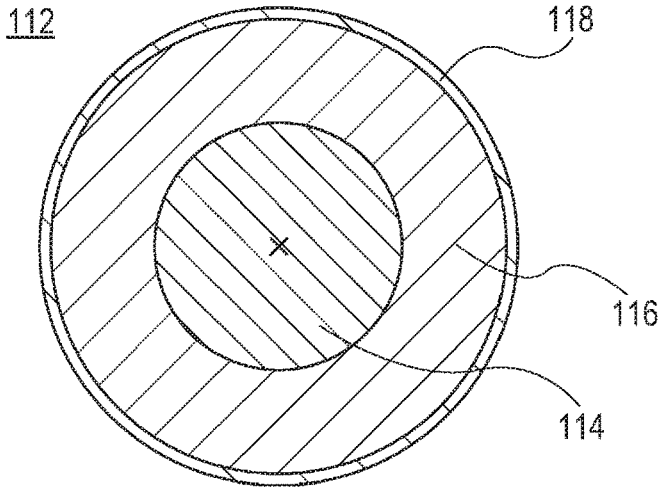
FIG. 2B is a cross-sectional view of a charging roller.

The image forming units 100K, 100Y, 100M, and 100C are identical in configuration, and hence will be collectively referred to as image forming unit 100 hereinafter. As illustrated in FIGS. 1 and 2A, the image forming unit 100 employs an electrophotographic system, and includes the following components: a photoconductor 102 having, for example, a cylindrical shape, which is used as an image carrier that carries an image formed by using toner, a charging device 110 serving as a charging unit that electrically charges the photoconductor 102, a latent image forming device 120 that applies light to the surface of the photoconductor 102 charged by the charging device 110 to thereby form an electrostatic latent image on the surface of the photoconductor 102, a developing device 130 serving as a developing unit that develops the latent image formed on the photoconductor 102 by use of a developer including toner to thereby form a toner image on the surface of the photoconductor 102, and a cleaning device 140 serving as a cleaning unit that cleans the photoconductor 102 after a toner image is transferred by the transfer device 200 to an intermediate transfer body 210 described later.

The charging device 110 has a charging roller 112, which is used as a charging member that comes into contact with the photoconductor 102 to charge the photoconductor 102. A charging voltage is applied to the charging roller 112 at predetermined timing so that the charging roller 112 charges the photoconductor 102. Details of the charger roller 112 according to Exemplary Embodiment 1 will be described later.

The developing device 130 has a developing device body 132. The developing device body 132 is equipped with a developer transport member 134 in the form of, for example, a roller. A developer as a mixture of, for example, toner, an external additive, and carrier is contained in the developing device body 132. The toner contained in this developer is transported toward the photoconductor 102 by the developer transport member 134.

The cleaning device 140 has a cleaning member 142 having, for example, a plate-like shape that comes into contact with the surface of the photoconductor 102 to clean the surface of the photoconductor 102. The cleaning member 142, which is pressed against the photoconductor 102, cleans the photoconductor 102 by scraping off, from the surface of the photoconductor 102, substances such as toner remaining on the surface of the photoconductor 102 or paper dust adhering to the photoconductor 102.

The fixing device 480 includes a heat roller 482 having an internal heat source, and a pressure roller 484 in contact with the heat roller 482. At the contact of the heat roller 482 and the pressure roller 484, heat and pressure are applied to the toner transferred to the paper to thereby fix a toner image to the paper.

The transfer device 200 as a transfer unit has the intermediate transfer body 210 that carries an image. The intermediate transfer body 210 is a belt-like member of, for example, an endless configuration. The intermediate transfer body 210 is supported by, for example, six support rollers 220, 222, 224, 226, 228, and 230 such that the intermediate transfer body 210 is rotatable in a direction indicated by an arrow "a" in FIG. 1.

At least one of the six support rollers is used as a driving roller that transmits a drive to the intermediate transfer body 210. In Exemplary Embodiment 1, the support roller 230 is used as the driving roller. The support roller 230 is coupled with, for example, a drive source 234 such as a motor. The support roller 226 is used as an opposed roller that is opposed to a second transfer roller 250 with the intermediate transfer body 210 interposed therebetween.

The transfer device 200 has first transfer rollers 240K, 240Y, 240M, and 240C each used as a first transfer member. The first transfer rollers 240K, 240Y, 240M, and 240C are each disposed on the inside of the intermediate transfer body 210 so as to face the corresponding one of the four photoconductors 102 with the intermediate transfer body 210 interposed therebetween. A first transfer bias is applied to each of the first transfer rollers 240K, 240Y, 240M, and 240C so that toner images of the corresponding colors are transferred to the intermediate transfer body 210 from the four photoconductors 102 by the first transfer rollers 240K, 240Y, 240M, and 240C. The first transfer rollers 240K, 240Y, 240M, and 240C will be sometimes collectively referred to as first transfer roller 240.

The transfer device 200 also has the second transfer roller 250. The second transfer roller 250 is used as a rotary body that comes into contact with the intermediate transfer body 210 so as to form a transfer region N where a toner image is transferred to paper from the intermediate transfer body 210. A second transfer bias is applied to the second transfer roller 250 so that a toner image is transferred to the paper from the intermediate transfer body 210 by the second transfer roller 250. The second transfer roller 250 is pressed against the intermediate transfer body 210 by a pressing mechanism or other mechanisms (not illustrated).

The paper feeder 400 supplies paper toward the transfer region N. The paper feeder 400 has a paper container 402 in which stacked sheets of paper are contained, and a sending roller 404 that sends the paper from the paper container 402.

The transport path 500 is used to transport paper from the paper feeder 400 toward the transfer region N and from the transfer region N toward the fixing device 480, and then eject the paper from the image forming apparatus body 12. In the vicinity of the transport path 500, the following components are disposed along the transport path 500 in the order stated below from the upstream side with respect to the direction of transport of paper: the sending roller 404, a transport roller 510, a registration roller 520, the second transfer roller 250, and the fixing device 480.

The registration roller 520 temporarily stops the movement of the leading end portion of paper as the paper is transported toward the transfer region N. Then, the registration roller 520 causes the movement of the leading end portion of the paper toward the transfer region N to resume in synchronization with the timing at which a toner image is transported to the transfer region N by the intermediate transfer body 210.

Next, a description is given of how discharge products adhering to the photoconductor 102 are removed in the image forming apparatus 10 according to Exemplary Embodiment 1.

Discharge products such as $NO_x$ generated due to electric discharge caused by the charging device 110 adhere to the photoconductor 102. If left adhering to the photoconductor 102, such discharge products cause defects in the image being developed. Accordingly, such discharge products need to be removed from the photoconductor 102.

Exemplary Embodiment 1 employs the charging roller 112 of the charging device 110 to remove discharge products from the photoconductor 102. That is, according to Exemplary Embodiment 1, discharge products on the photoconductor 102 are removed by the charging roller 112 through the following process. First, a toner image 700 (to be sometimes also referred to as "toner 700" hereinafter) is developed on the photoconductor 102 when the image forming apparatus 10 is not performing image formation. After the toner image 700 is carried onto the charging roller 112, the photoconductor 102 and the charging roller 112 are made to rotate at peripheral velocities different from each other. This causes discharge products adhering to the surface of the photoconductor 102 to adhere onto the toner 700 on the charging roller 112, thus removing the discharge products (see FIGS. 4A and 4B and FIGS. 5A and 5B). Details of the above-mentioned process will be described later.

First, the charging roller 112 of the charging device 110 used to remove discharge products will be described with reference to FIGS. 2A and 2B and FIGS. 3A to 3D. The charging roller 112 is formed as a rotatable cylindrical body with a predetermined length. Further, the charging roller 112 according to Exemplary Embodiment 1 is made up of multiple layers, for example, three layers including a cylindrical shaft 114 at the center, a conductive elastic layer 116 located on the outside of the shaft 114, and a fiber layer 118 located on the outside of the elastic layer 116 and made of conductive fibers.

The shaft 114 serves as a rotational axis. The shaft 114 is formed by, for example, a cylindrical body made of a metallic material such as iron or SUS. Each end of the shaft 114 serves as a support portion rotatably supported on the charging device 110 and driven by the driving unit.

The elastic layer 116 is formed by a resilient tubular body, for example, a sponge-like conductive cylindrical body made of a urethane foam containing a conductive agent such as carbon black.

The fiber layer 118 absorbs toner when supplied with electric power. As the fiber layer 118, for example, a fabric member produced by weaving nylon conductive yarns with carbon black dispersed therein is used. According to Exemplary Embodiment 1, the conductive fibers of the fiber layer 118 are desirably woven such that, in comparison to a so-called plain weave 610 illustrated in FIG. 3D with warp yarns 600 and weft yarns 602 alternately brought to the surface, a greater portion of either one of the warp yarns 600 and the weft yarns 602 is brought to the surface than the other, for example, a satin weave 620 illustrated in FIG. 3B produced by interfacing of yarns with either the warp yarns 600 or the weft yarns 602 floating over a longer distance, or a twill weave 630 illustrated in FIG. 3C in which two or more warp yarns 600 or weft yarns 602 are woven in regular succession.

When the fiber layer 118 is formed with either the satin weave 620 or the twill weave 630 in this way, either the warp yarns 600 or the weft yarns 602 with toner carried thereon at a high density are brought to the surface over a longer distance. This enhances the capability to remove discharge products. Further, the resulting structure has fewer recesses than the plain weave 610, which helps to reduce charge non-uniformity.

Figure 3A:
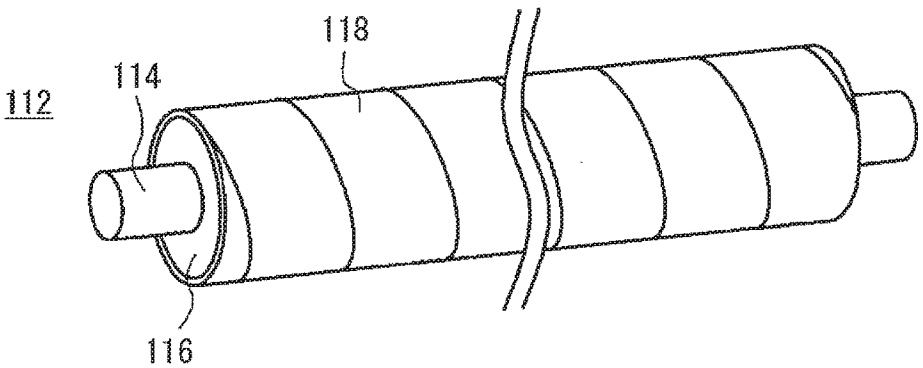
FIG. 3A is a perspective view of the charging roller.
Figure 3B:
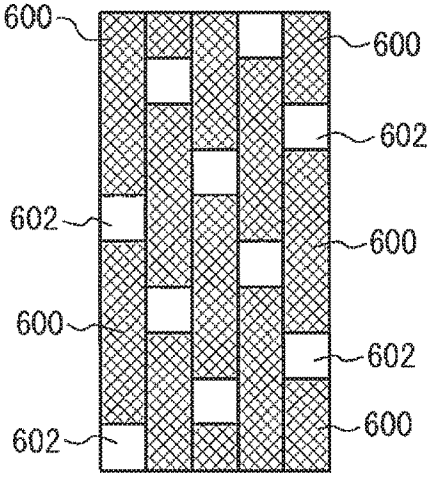
FIG. 3B is a plan view of a portion of a satin-woven fabric member of a fiber layer of the charging roller.
Figure 3C:
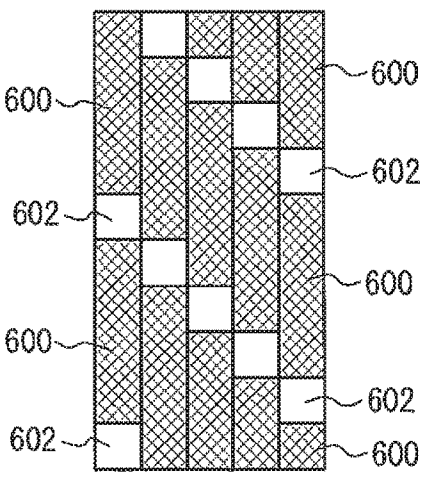
FIG. 3C is a plan view of a portion of a twill-woven fabric member.
Figure 3D:
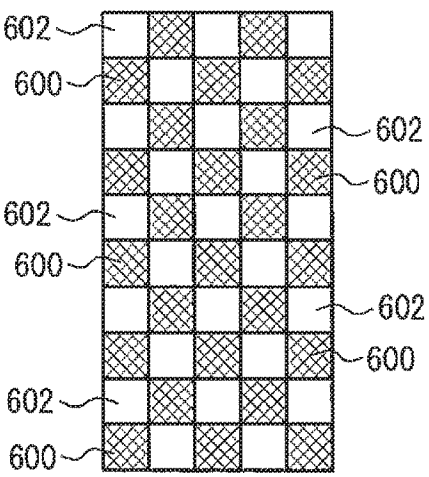
FIG. 3D is a plan view of a plain weave.

As illustrated in FIG. 3A, the fiber layer 118 of the charging roller 112 according to Exemplary Embodiment 1 is formed by winding a fabric member having a small line width on the elastic layer 116 in a spiral fashion.

Next, with reference to FIGS. 4A and 4B and FIGS. 5A and 5B, a detailed description will be given of how discharge products on the photoconductor 102 are removed in the image forming apparatus 10 according to Exemplary Embodiment 1. In Exemplary Embodiment 1, during supply of toner to the charging roller 112 to remove discharge products, the photoconductor 102 is rotated in a direction opposite to the direction in which the photoconductor 102 is normally rotated during an image forming operation.

First, when the image forming apparatus 10 is not performing image formation, the toner image 700 is developed by the developing device on the photoconductor 102 that is rotating clockwise as in normal operation (see FIG. 2A). At this time, for example, the toner image 700 has a long length relative to the circumference of the charging roller 112, and the toner image 700 is developed at a density of about 30% as opposed to 100% in the case of development of a normal solid toner image.

Figure 4A:
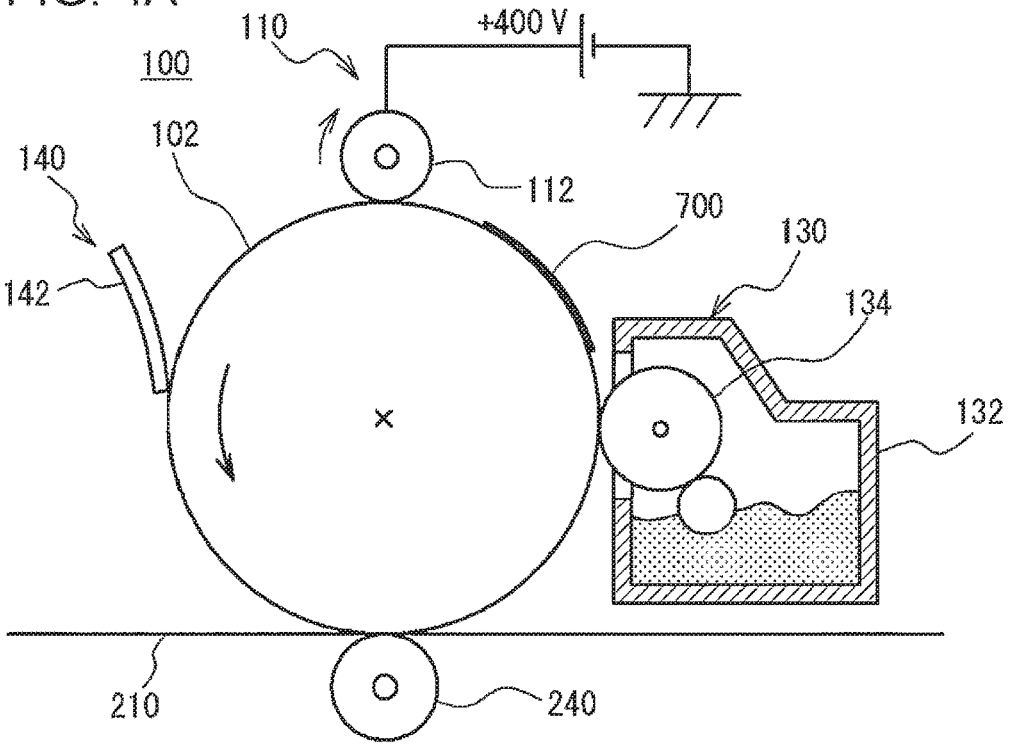
FIG. 4A is an illustration, corresponding to FIG. 2A, of a process that removes discharge products according to Exemplary Embodiment 1.

Thereafter, as illustrated in FIG. 4A, the photoconductor 102 is rotated in a direction opposite to the normal rotational direction, that is, counter-clockwise, causing the toner image 700 developed on the photoconductor 102 to move toward the charging roller 112. At this time, a positive (+) voltage, for example, +400 V is applied to the charging roller 112 to cause the toner image 700 to be carried onto the charging roller 112. This voltage application is performed for several seconds.

Figure 4B:
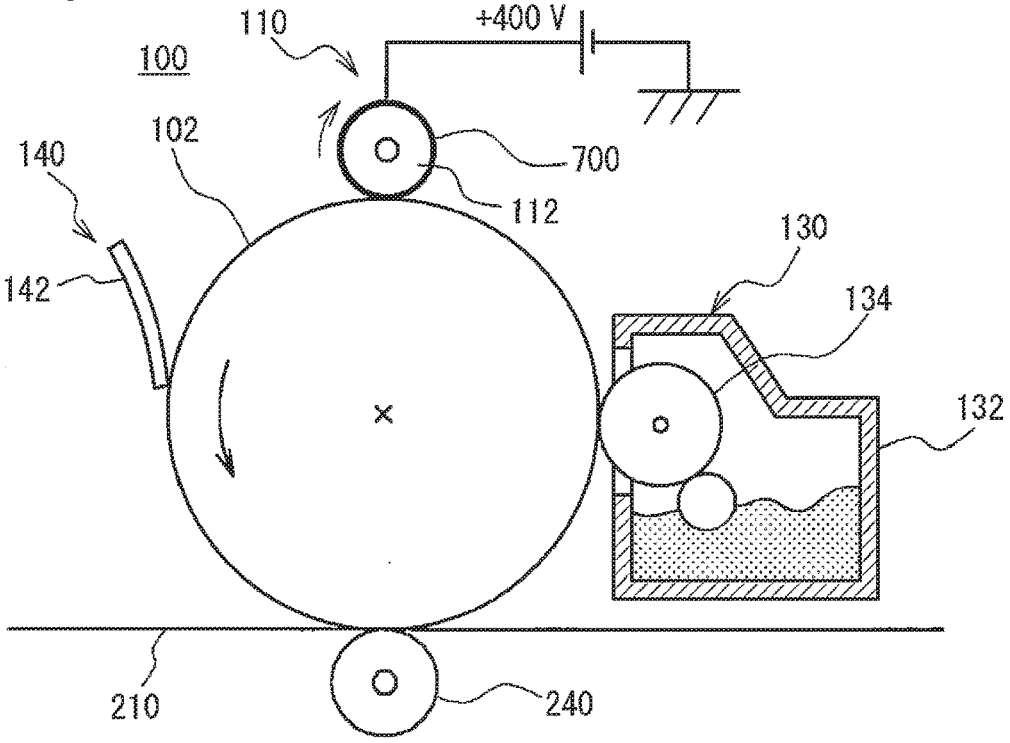
FIG. 4B illustrates a continuation of the process from FIG. 4A.

Thereafter, the toner image 700 on the photoconductor 102 is moved to a position contacting the charging roller 112 that is being placed at a positive voltage. As a result, the toner image 700 is carried onto the charging roller 112 as illustrated in FIG. 4B.

Figure 5A:
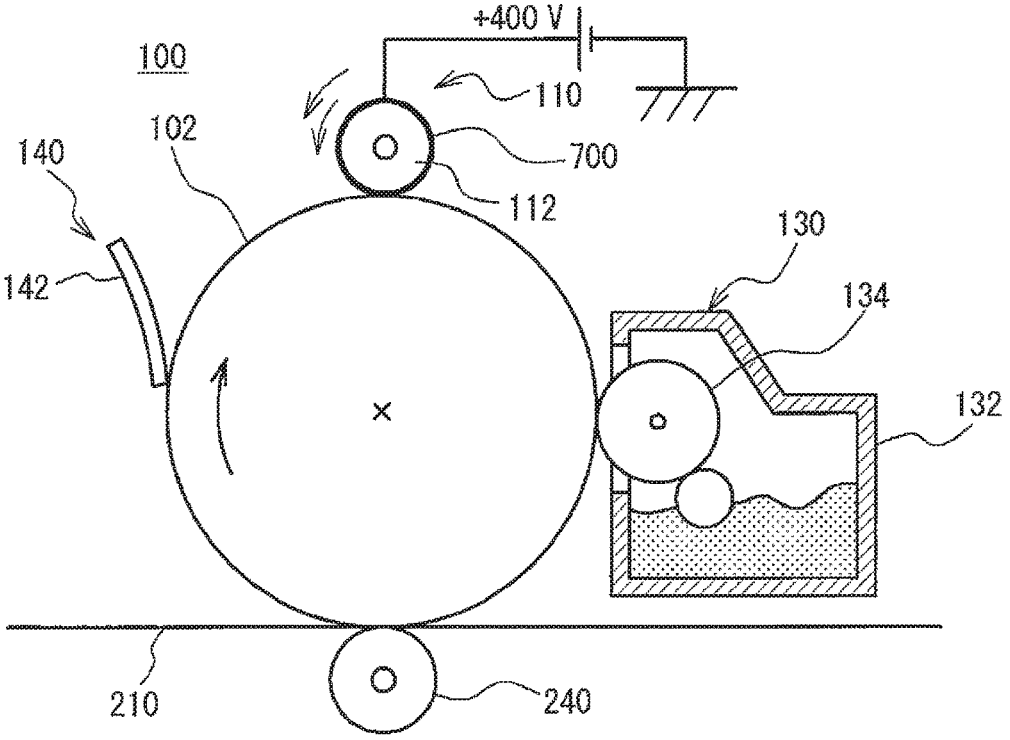
FIG. 5A illustrates a continuation, from FIG. 4B, of the process that removes discharge products according to Exemplary Embodiment 1.

After the toner image 700 is carried onto the charging roller 112, the photoconductor 102 is made to rotate in the normal direction as illustrated in FIG. 5A. At this time, the charging roller 112 is rotated at a peripheral velocity higher than the peripheral velocity of the photoconductor 102, for example, about 1.2 times higher than the peripheral velocity of the photoconductor 102.

When the charging roller 112 with the toner image 700 carried thereon is rotated at a peripheral velocity higher than the peripheral velocity of the photoconductor 102 as described above, the toner image 700 carried on the charging roller 112 is caused to slide and rub against the surface of the photoconductor 102. This allows discharge products on the photoconductor 102 to move onto the toner image 700 carried on the charging roller 112. As a result, the discharge products on the photoconductor 102 are removed and cleaned away.

Figure 5B:
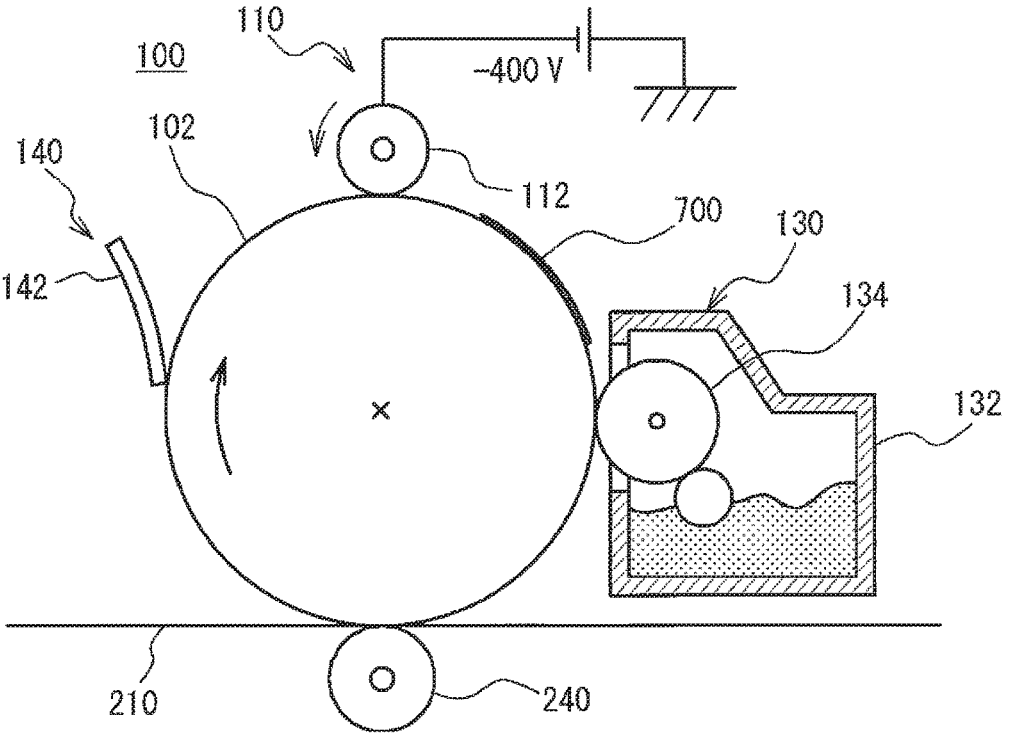
FIG. 5B illustrates a continuation of the process from FIG. 5A.

After the removal of discharge products on the photoconductor 102 is finished, as illustrated in FIG. 5B, a negative (−) voltage, for example, −400 V is applied to the charging roller 112 so that the toner image 700 carried on the charging roller 112 and including the discharge products is moved onto the photoconductor 102.

Then, the toner image 700 moved onto the photoconductor 102 is collected by the developing device 130 or cleaned away by the cleaning device 140 so that the toner image 700 is removed from the photoconductor 102.

The above completes the removal of discharge products on the photoconductor 102 according to Exemplary Embodiment 1. Thereafter, a normal image forming operation is performed by the image forming apparatus 10. This configuration enables the image forming apparatus 10 according to Exemplary Embodiment 1 to remove discharge products adhering to the photoconductor 102 without use of another device or structure. This enables a reduction in the number of components required for removing the discharge products.

Although in Exemplary Embodiment 1 a positive (+400 V) voltage is applied to cause the toner image 700 to be carried onto the charger roller 112, this is not to be construed restrictively. If the charging roller 112 used is capable of carrying the toner image 700 with no applied voltage, no voltage needs to be applied.

Although a negative (−400 V) voltage is applied to cause the toner image 700 to move back to the photoconductor 102 from the charging roller 112, this is not to be construed restrictively. If it is possible to cause the toner image 700 to move back to the photoconductor 102 with application of a voltage (AC+DC) normally applied in image forming operation, an AC+DC voltage may be applied instead of a negative voltage.

As the charging roller 112, not only a charging roller to which an AC+DC voltage is applied during image formation but also a charging roller to which a DC voltage is applied during image formation may be used.

As the elastic layer 116 of the charging roller 112, not only a urethane foam but also a rubber material such as nitrile-butadiene rubber (NBR), styrene-butadiene rubber (SBR), or ethylene propylene-diene-methylene rubber (EPDM) may be used.

As the conductive fibers forming the fiber layer 118 of the charging roller 112, not only nylon conductive yarns but also, for example, various conductive fibers such as acrylic, rayon, or polyester fibers may be used.

Instead of winding the fiber layer 118 on the elastic layer of the charging roller 112 in a spiral manner, the conductive fibers of the fiber layer 118 may be woven into an endless tubular weave which is disposed over the elastic layer 116.

As the fibers forming the fiber layer 118 of the charging roller 112, thick fibers may be used for increased strength, or thin fibers may be used for enhanced scraping.

Although the charging roller 112 according to Exemplary Embodiment 1 includes the fiber layer 118 bonded onto the elastic layer 116, the fiber layer 118 may be increased in thickness to exhibit resilience so that the fiber layer 118 is directly bonded onto the shaft 114.

In Exemplary Embodiment 1, to move the toner image 700 carried on the charging roller 112 onto the photoconductor 102, the charging roller 112 is rotated at a peripheral velocity higher than the peripheral velocity at which the photoconductor 102 rotates. However, this is not to be construed restrictively. As long as the charging roller 112 and the photoconductor 102 are rotated at different peripheral velocities, the charging roller 112 may be rotated at any peripheral velocity, for example, at a peripheral velocity lower than that of the photoconductor 102. Further, the charging roller 112 and the photoconductor 102 may be rotated in opposite directions. This configuration also allows the surface of the photoconductor 102 to be rubbed by the toner image 700 carried on the charging roller 112.

Although Exemplary Embodiment 1 uses a fabric member woven of conductive yarns as the fiber layer 118 representing the surface layer of the charging roller 112, this is not to be construed restrictively. Materials such as a fabric member produced by knitting conductive yarns, or a non-woven fabric made using conductive yarns may be used. Alternatively, instead of using conductive yarns, insulating yarns may be knit and then subjected to a process that makes the knit yarns conductive. Further, a conductive rubber member or brush member capable of being electrically charged may be used. Use of various fabric members, rubber members, or brush members exemplified above also allows toner to be carried on the charging roller to enable removal of discharge products on the photoconductor as in Exemplary Embodiment 1.

Exemplary Embodiment 2

Next, with reference to FIG. 1 to FIG. 3D, FIGS. 6A and 6B, and FIGS. 7A and 7B, a description is given of how discharge products on the photoconductor 102 are removed in an image forming apparatus 10A according to Exemplary Embodiment 2. The image forming apparatus 10A according to Exemplary Embodiment 2 differs from the image forming apparatus 10 according to Exemplary Embodiment 1 only in a portion of its configuration related to removal of discharge products. Accordingly, features identical to those in Exemplary Embodiment 1 are designated by the same reference signs to avoid a detailed description of such features.

As in the image forming apparatus 10 according to Exemplary Embodiment 1, in the image forming apparatus 10A according to Exemplary Embodiment 2, a cleaning member 142A of a cleaning device 140A is able to be moved when discharge products on the photoconductor 102 are to be removed. Hereinafter, with reference to FIGS. 6A and 6B and FIGS. 7A and 7B, a description is given of how discharge products on the photoconductor 102 are removed in the image forming apparatus 10A according to Exemplary Embodiment 2.

In Exemplary Embodiment 2, supply of toner to the charging roller 112 to remove discharge products is performed with the cleaning member 142A of the cleaning device 140A moved away from the photoconductor 102 while keeping the photoconductor 102 rotating in a normal manner.

Figure 6A:
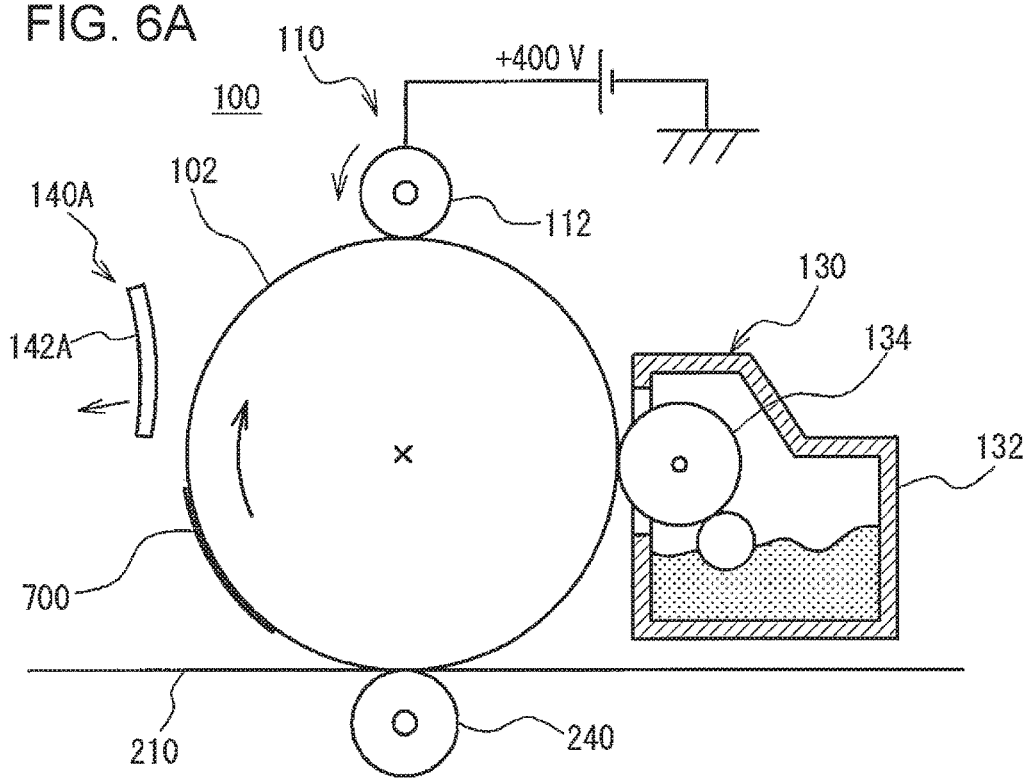
FIG. 6A is an illustration, corresponding to FIG. 2A, of a process that removes discharge products according to Exemplary Embodiment 2.

That is, as illustrated in FIG. 6A, when the image forming apparatus 10A is not performing image formation, the cleaning member 142A of the cleaning device 140A is brought out of contact with the photoconductor 102 so as to leave a gap between the photoconductor 102 and the cleaning member 142A. At the same time, as in normal developing operation, the toner image 700 is developed by the developing device 130 on the photoconductor 102 that is rotating clockwise in FIG. 6A. At this time, for example, the toner image 700 has a long length relative to the circumference of the charging roller 112, and the toner image 700 is developed at a density of about 30% as opposed to 100% in the case of development of a normal solid toner image.

Further, a configuration is employed that prevents the toner image 700 developed on the photoconductor 102 from being transferred to the intermediate transfer body 210 when the toner image 700 passes the intermediate transfer body 210 as the photoconductor 102 rotates. This is accomplished by applying a voltage that does not cause the toner image 700 from being transferred to the intermediate transfer body 210 by the first transfer roller 240 of the transfer device 200 as the toner image 700 is supplied to the photoconductor 102 from the developing device 130.

Figure 6B:
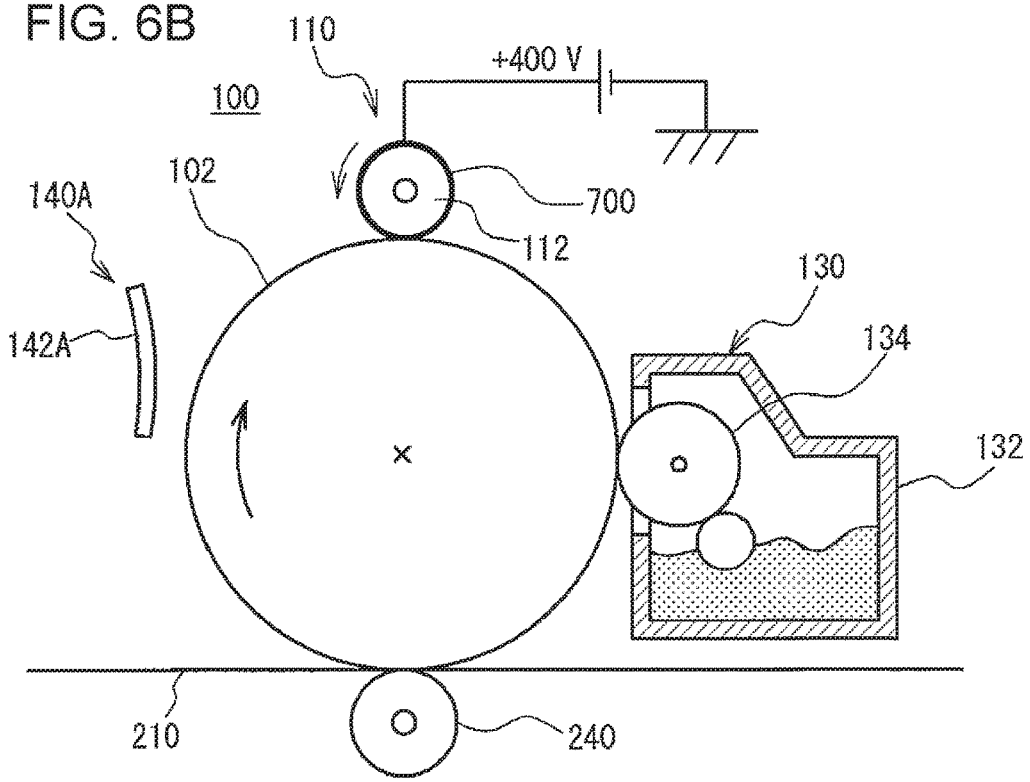
FIG. 6B illustrates a continuation of the process from FIG. 6A.

Then, as illustrated in FIGS. 6A and 6B, the toner image 700 is made to pass the cleaning member 142A moved away from the photoconductor 102, and the toner image 700 having passed the cleaning member 142A is carried onto the charging roller 112. At this time, a positive (+) voltage, for example, +400 V is applied to the charging roller 112 to cause the toner image 700 to be carried onto the charging roller 112. This voltage application is performed for several seconds.

Then, the toner image 700 on the photoconductor 102 is moved to a position contacting the charging roller 112 that is being placed at a positive voltage. As a result, the toner image 700 is carried onto the charging roller 112 as illustrated in FIG. 6B.

Figure 7A:
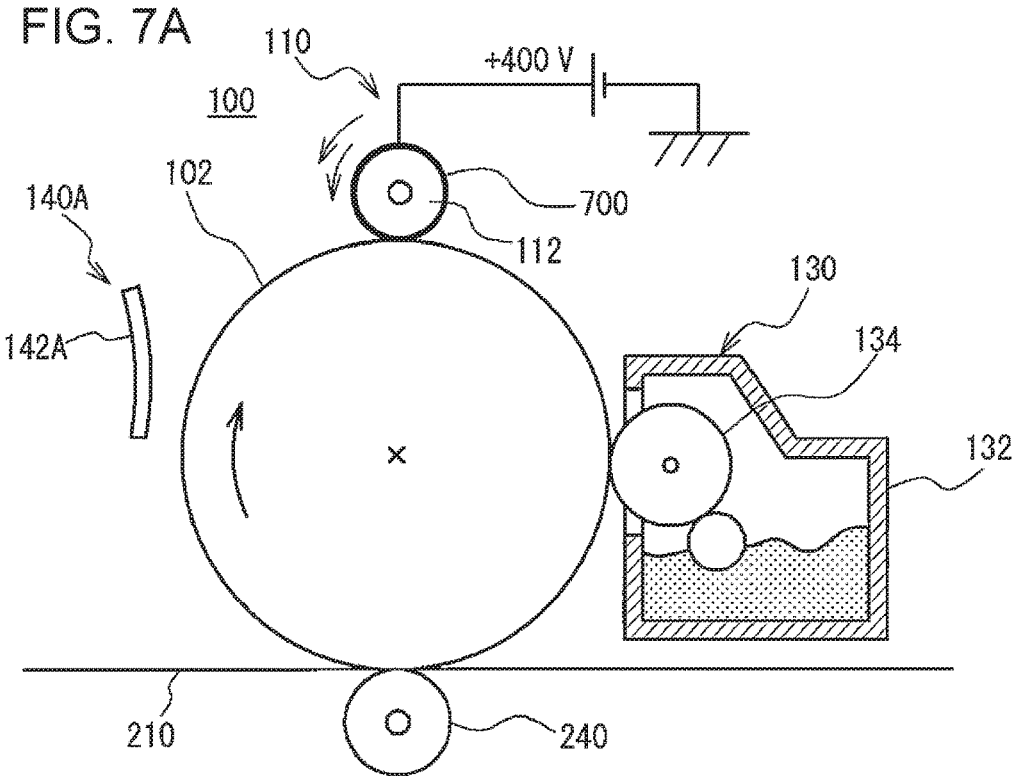
FIG. 7A illustrates a continuation, from FIG. 6B, of the process that removes discharge products according to Exemplary Embodiment 2.

Thereafter, discharge products on the photoconductor 102 are removed by the toner image 700 carried on the charging roller 112. That is, after the toner image 700 is carried onto the charging roller 112, as illustrated in FIG. 7A, the charging roller 112 is rotated at a peripheral velocity higher than the peripheral velocity of the photoconductor 102, for example, about 1.2 times higher than the peripheral velocity of the photoconductor 102.

When the charging roller 112 with the toner image 700 carried thereon is rotated at a peripheral velocity higher than the peripheral velocity of the photoconductor 102 as described above, the toner image 700 carried on the charging roller 112 is caused to slide and rub against the surface of the photoconductor 102. This allows discharge products on the photoconductor 102 to move onto the toner image 700 carried on the charging roller 112. As a result, the discharge products on the photoconductor 102 are removed and cleaned away.

Figure 7B:
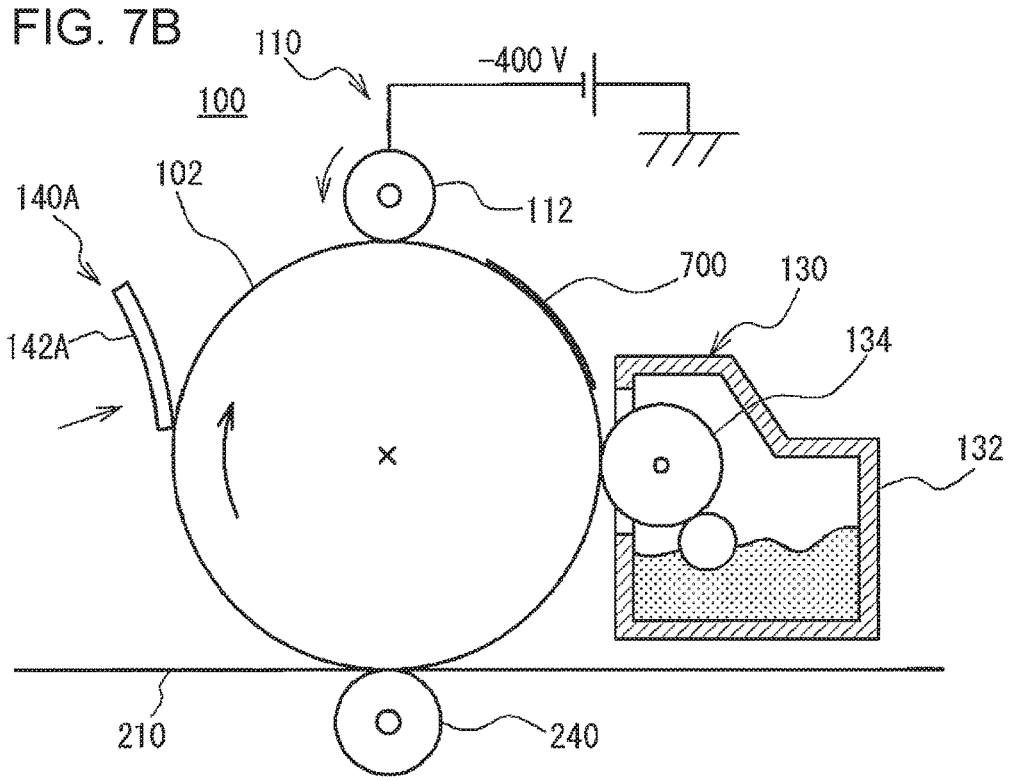
FIG. 7B illustrates a continuation of the process from FIG. 7A.

After the removal of discharge products on the photoconductor 102 is finished, as illustrated in FIG. 7B, a negative (−) voltage, for example, −400 V is applied to the charging roller 112 so that the toner image 700 carried on the charging roller 112 and including the discharge products is moved onto the photoconductor 102.

Then, the toner image 700 moved onto the photoconductor 102 is collected by the developing device 130 or cleaned away by the cleaning device 140 so that the toner image 700 is removed from the photoconductor 102.

The above completes the removal of discharge products on the photoconductor 102 according to Exemplary Embodiment 2. Thereafter, a normal image forming operation is performed by the image forming apparatus 10A. At this time, before the normal image forming operation is performed, the cleaning member 142A moved away from the photoconductor 102 is moved into contact with the photoconductor 102 (see FIG. 7B).

This configuration enables the image forming apparatus 10A according to Exemplary Embodiment 2 to remove discharge products adhering to the photoconductor 102 without use of another device. This enables a reduction in the number of components required for removing the discharge products.

Exemplary Embodiment 3

Next, with reference to FIG. 1 to FIG. 3D, FIGS. 8A and 8B, and FIGS. 9A and 9B, a description is given of how discharge products on the photoconductor 102 are removed in an image forming apparatus 10B according to Exemplary Embodiment 3. The image forming apparatus 10B according to Exemplary Embodiment 3 differs from the image forming apparatus 10 according to Exemplary Embodiment 1 only in the configuration of a cleaning device 140B. Accordingly, features identical to those in Exemplary Embodiment 1 are designated by the same reference signs to avoid a detailed description of such features.

The image forming apparatus 10B according to Exemplary Embodiment 3 differs from the image forming apparatus 10 according to Exemplary Embodiment 1 in that the cleaning device 140B uses, instead of the cleaning member 142 having a plate-like configuration, a conductive brush member 144 that is rotated.

Figure 8A:
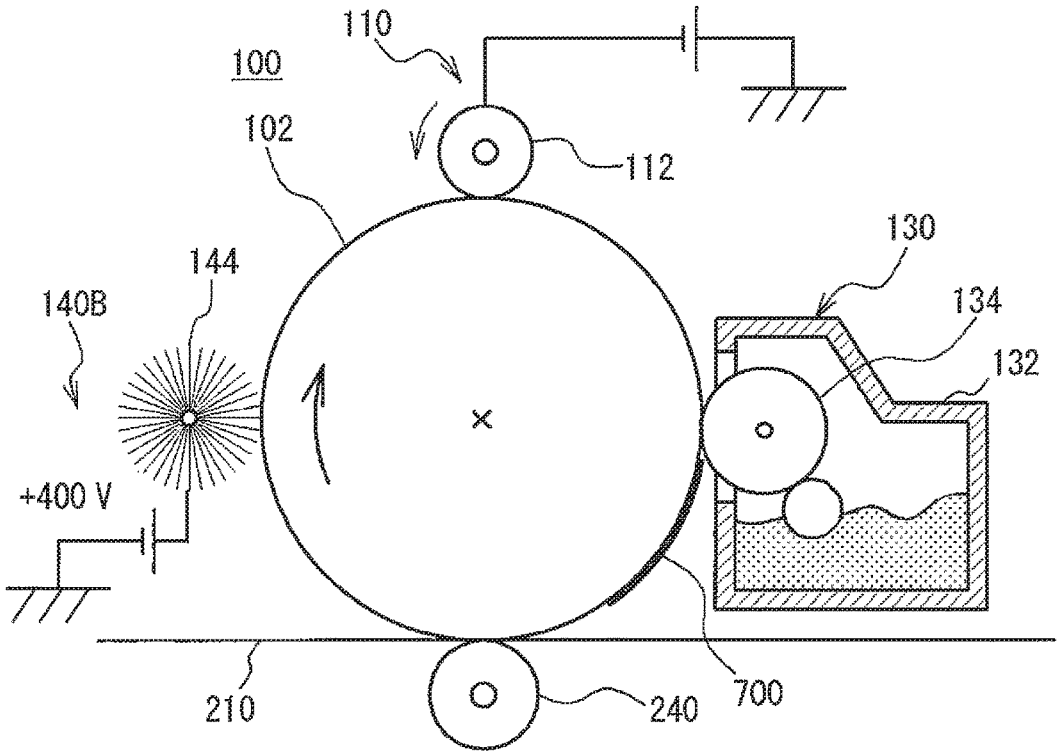
FIG. 8A is an illustration, corresponding to FIG. 2A, of a process that removes discharge products according to Exemplary Embodiment 3.
Figure 8B:
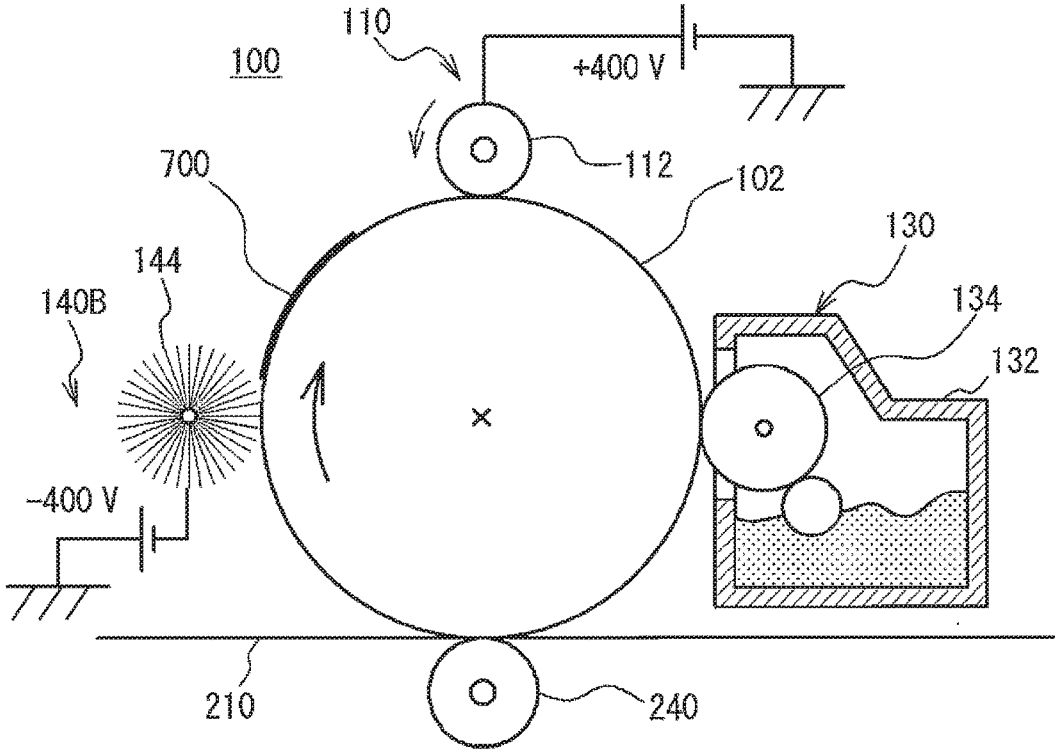
FIG. 8B illustrates a continuation of the process from FIG. 8A.

As illustrated in FIG. 8A, the cleaning device 140B according to Exemplary Embodiment 3 electrostatically cleans the toner on the photoconductor 102 when a positive (+) voltage, for example, +400 V is applied to the conductive brush member 144. The brush member 144 of the cleaning device 140B according to Exemplary Embodiment 3 is provided with a cleaning device (not illustrated) that cleans toner or other materials adhering to the brush member 144.

Hereinafter, with reference to FIGS. 8A and 8B and FIGS. 9A and 9B, a description is given of how discharge products on the photoconductor 102 are removed in the image forming apparatus 10B according to Exemplary Embodiment 3.

First, as illustrated in FIG. 8A, when the image forming apparatus 10B is not performing image formation, the toner image 700 is developed by the developing device 130 on the photoconductor 102 that is rotating clockwise in FIG. 8A as in normal operation. At this time, for example, the toner image 700 has a long length relative to the circumference of the charging roller 112, and the toner image 700 is developed at a density of about 30% as opposed to 100% in the case of development of a normal solid toner image.

Further, a configuration is employed that prevents the toner image 700 developed on the photoconductor 102 from being transferred to the intermediate transfer body 210 when the toner image 700 passes the intermediate transfer body 210 as the photoconductor 102 rotates. As in Exemplary Embodiment 2 mentioned above, this is accomplished by applying a voltage that does not cause the toner image 700 from being transferred to the intermediate transfer body 210 by the first transfer roller 240 of the transfer device 200 as the toner image 700 is supplied to the photoconductor 102 from the developing device 130.

Thereafter, the toner image 700 on the photoconductor 102 moves to a position contacting the brush member 144 of the cleaning device 140B. At this time, to prevent the toner image 700 from being collected by the brush member 144 of the cleaning device 140B, a negative (−) voltage, for example, −400 V is applied to the brush member 144 (see FIG. 8B).

Figure 9A:
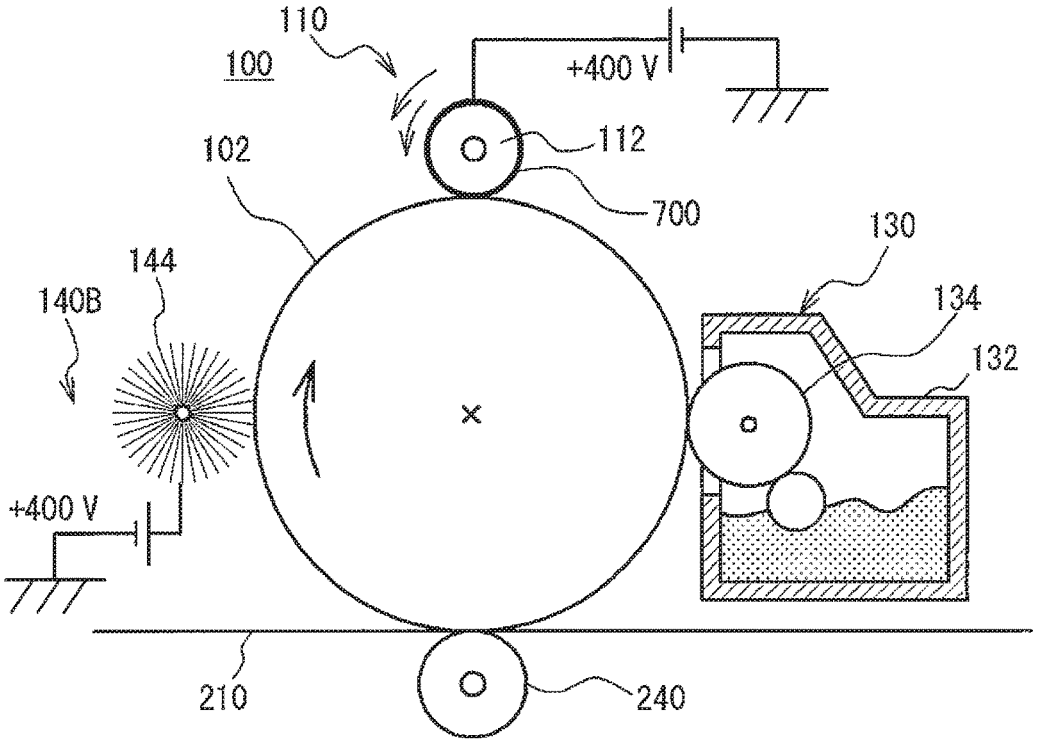
FIG. 9A illustrates a continuation, from FIG. 8B, of the process that removes discharge products according to Exemplary Embodiment 3.

Then, as illustrated in FIG. 9A, the toner image 700 having passed the brush member 144 is carried onto the charging roller 112. At this time, a positive (+) voltage, for example, +400 V is applied to the charging roller 112 to cause the toner image 700 to be carried onto the charging roller 112. This voltage application is performed for several seconds. Then, the toner image 700 on the photoconductor 102 is moved to a position contacting the charging roller 112 that is being placed at a positive voltage. As a result, the toner image 700 is carried onto the charging roller 112.

Thereafter, discharge products on the photoconductor 102 are removed by the toner image 700 carried on the charging roller 112. That is, after the toner image 700 is carried onto the charging roller 112, as illustrated in FIG. 9A, the charging roller 112 is rotated at a peripheral velocity higher than the peripheral velocity of the photoconductor 102, for example, about 1.2 times higher than the peripheral velocity of the photoconductor 102.

When the charging roller 112 with the toner image 700 carried thereon is rotated at a peripheral velocity higher than the peripheral velocity of the photoconductor 102 as described above, the toner image 700 carried on the charging roller 112 is caused to slide and rub against the surface of the photoconductor 102. This allows discharge products on the photoconductor 102 to move onto the toner image 700 carried on the charging roller 112. As a result, the discharge products on the photoconductor 102 are removed and cleaned away.

Figure 9B:
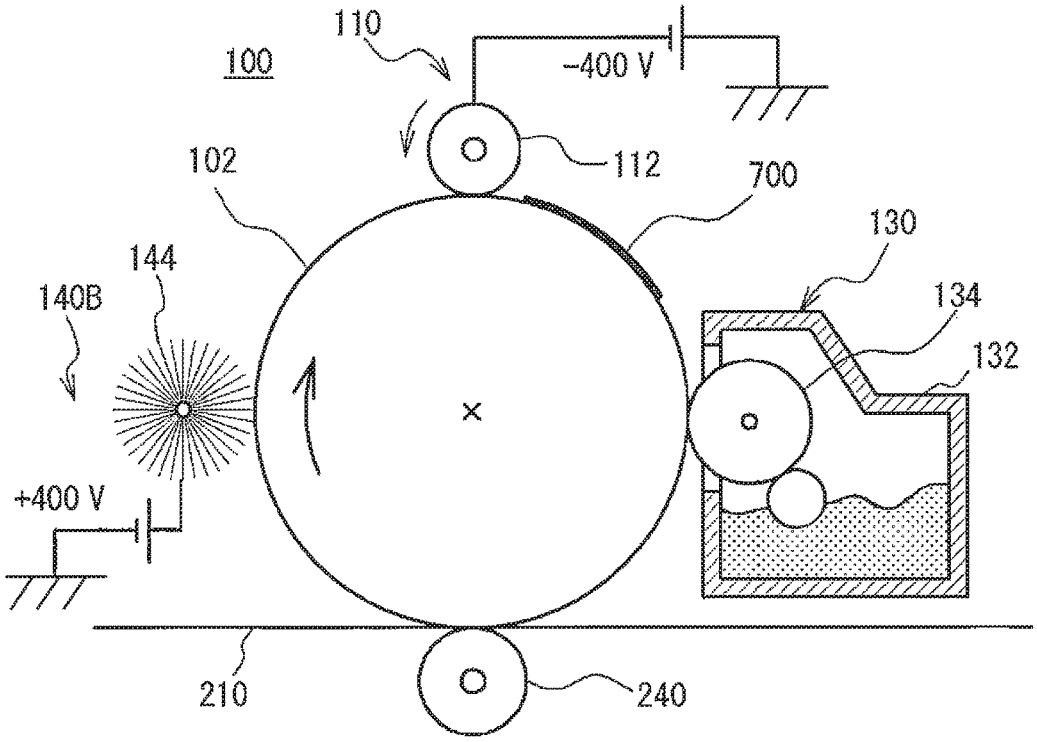
FIG. 9B illustrates a continuation of the process from FIG. 9A.

After the removal of discharge products on the photoconductor 102 is finished, as illustrated in FIG. 9B, a negative (−) voltage, for example, −400 V is applied to the charging roller 112 so that the toner image 700 carried on the charging roller 112 and including the discharge products is moved onto the photoconductor 102.

Then, the toner image 700 moved onto the photoconductor 102 is collected by the developing device 130 or cleaned away by the cleaning device 140 so that the toner image 700 is removed from the photoconductor 102.

The above completes the removal of discharge products on the photoconductor 102 according to Exemplary Embodiment 3. Thereafter, a normal image forming operation is performed by the image forming apparatus 10B. At this time, before the normal image forming operation is performed, the brush member 144 of the cleaning device 140B is applied with a voltage that allows the toner to be collected by the brush member 144 (see FIG. 9B).

This configuration enables the image forming apparatus 10B according to Exemplary Embodiment 3 to remove discharge products adhering to the photoconductor 102 without use of another device or structure. This enables a reduction in the number of components required for removing the discharge products.

The image forming apparatus 10B according to Exemplary Embodiment 3 uses the brush member 144 as the cleaning member of the cleaning device 140B. This eliminates the need to employ, for example, a complicated mechanism that causes the plate-like cleaning member 142A according to Exemplary Embodiment 2 to move away from the photoconductor 102 or causes the photoconductor 102 according to Exemplary Embodiment 1 to rotate in reverse.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a rotatable image carrier configured to carry an image;

a charging unit having a rotatable charging member configured to charge the image carrier;

a developing unit configured to supply a developer including at least toner to the charged image carrier; and a cleaning unit having a cleaning member configured to clean a surface of the image carrier, wherein the image forming apparatus is configured such that at least when the image forming apparatus is not performing image formation, the charging member, on which toner from the image carrier is carried, is caused to rotate at a peripheral velocity different from a peripheral velocity at which the image carrier rotates, and wherein the cleaning unit is configured to, in response to supply of the toner from the developing unit to the image carrier, move the cleaning member away from the image carrier such that the toner is supplied to the charging member.

2. The image forming apparatus according to claim 1, wherein the image forming apparatus is configured such that the toner supplied by the developing unit to the image carrier is carried onto the charging member.

3. The image forming apparatus according to claim 1, wherein the image forming apparatus is configured such that in the charging unit, the charging member is applied with a voltage that causes the toner to be carried onto the charging member.

4. The image forming apparatus according to claim 3, wherein the image forming apparatus is configured such that in the charging unit, the charging member is applied with a voltage that causes the toner carried on the charging member to move onto the image carrier.

5. The image forming apparatus according to claim 1, wherein in the cleaning unit, the cleaning member is applied with a voltage when cleaning the surface of the image carrier, and wherein in response to supply of the toner from the developing unit to the image carrier, the cleaning unit is applied with a voltage that does not cause the toner supplied to the image carrier to be cleaned away.

6. The image forming apparatus according to claim 1, further comprising:

a transfer unit to which an image formed by the developer supplied to the image carrier may be transferred, wherein the transfer unit is placed at a voltage that does not cause the toner supplied to the image carrier to be transferred to the transfer unit.

7. The image forming apparatus according to claim 1, wherein the image carrier is configured to, in response to supply of the toner from the developing unit, rotate in a direction opposite to a direction in which the image carrier rotates during image formation such that the toner is supplied to the charging member.

8. The image forming apparatus according to claim 1, wherein the cleaning member comprises a substantially plate-like body.

9. The image forming apparatus according to claim 1, wherein the cleaning member comprises a brush member.

10. The image forming apparatus according to claim 1, wherein the charging member comprises a conductive brush member.

11. An image forming apparatus comprising:

a rotatable image carrier configured to carry an image;

a charging unit having a rotatable charging member configured to charge the image carrier;

a developing unit configured to supply a developer including at least toner to the charged image carrier; and a cleaning unit having a cleaning member configured to clean a surface of the image carrier, wherein the image forming apparatus is configured such that at least when the image forming apparatus is not performing in formation, the charging member, on which toner from the image carrier is carried, is caused to rotate at a peripheral velocity different from a peripheral velocity at which the image carrier rotates, and wherein at least a surface layer of the charging member comprises a conductive fabric member.

12. The image forming apparatus according to claim 11, wherein the fabric member is woven of conductive yarns, and wherein a greater portion of one of the yarns in a warp direction and the yarns in a weft direction is brought to a surface of the fabric member facing the image carrier than another one of the yarns in the warp direction and the yarns in the weft direction.

13. The image forming apparatus according to claim 11, wherein the fabric member comprises a twill weave or satin weave woven with conductive yarns.

14. The image forming apparatus according to claim 11, wherein the charging member includes a resilient member disposed underneath the fabric member.

15. An image forming apparatus comprising:

a rotatable image carrier configured to carry an image;

a charging unit having a rotatable charging member configured to charge the image carrier;

a developing unit configured to supply a developer including at least toner to the charged image carrier; and a cleaning unit having a cleaning member configured to clean a surface of the image carrier, wherein the image forming apparatus is configured such that at least when the image forming apparatus is not performing image formation, the charging member, on which toner from the image carrier is carried, is caused to rotate at a peripheral velocity different from a peripheral velocity at which the image carrier rotates, and wherein the charging member has a surface layer formed by a conductive rubber member.

* * * * *